US008833926B1

(12) United States Patent
Walker et al.

(10) Patent No.: US 8,833,926 B1
(45) Date of Patent: Sep. 16, 2014

(54) CUSTOM FLUSH LINE GENERATION IN PRINTING SYSTEMS THAT UTILIZE INK DRYING LIMITS

(71) Applicants: Casey E. Walker, Boulder, CO (US); Scott Johnson, Erie, CO (US); Sean K. Fitzsimons, Thornton, CO (US); Stuart J. Boland, Denver, CO (US); William Edward Manchester, Erie, CO (US)

(72) Inventors: Casey E. Walker, Boulder, CO (US); Scott Johnson, Erie, CO (US); Sean K. Fitzsimons, Thornton, CO (US); Stuart J. Boland, Denver, CO (US); William Edward Manchester, Erie, CO (US)

(73) Assignee: Ricoh Company, Ltd., Tokyo (JP)

( * ) Notice: Subject to any disclaimer, the term of this patent is extended or adjusted under 35 U.S.C. 154(b) by 21 days.

(21) Appl. No.: 13/775,422

(22) Filed: Feb. 25, 2013

(51) Int. Cl.
*B41J 2/01* (2006.01)
*B41J 29/38* (2006.01)
*B41J 11/00* (2006.01)

(52) U.S. Cl.
CPC ..... *B41J 11/002* (2013.01)
USPC ..... 347/102; 347/16

(58) Field of Classification Search
USPC ..... 347/16, 101, 102, 108, 22, 28
See application file for complete search history.

(56) References Cited

U.S. PATENT DOCUMENTS

| | | | | |
|---|---|---|---|---|
| 6,145,954 | A * | 11/2000 | Moore | 347/28 |
| 6,149,327 | A | 11/2000 | Ward et al. | |
| 7,213,902 | B2 * | 5/2007 | DeVivo et al. | 347/22 |
| 7,614,723 | B2 | 11/2009 | Hatayama | |
| 8,147,021 | B2 | 4/2012 | Nishizaka et al. | |
| 8,262,196 | B2 | 9/2012 | Mitchell et al. | |
| 8,287,087 | B2 | 10/2012 | Sano | |
| 2012/0313991 | A1 | 12/2012 | Itogawa | |

* cited by examiner

*Primary Examiner* — Kristal Feggins
(74) *Attorney, Agent, or Firm* — Duft Bornsen & Fettig LLP

(57) ABSTRACT

Systems and methods are provided for generating flush lines for printers. The system includes a flush line generator able to receive a print job, to determine a drying limit that defines a maximum areal density of ink for the print job that may be dried by a dryer, and to generate a flush line based on the drying limit that does not exceed the drying limit. The system further includes a marking engine able to mark the print job and the flush line onto a web of printable media upstream from the dryer.

20 Claims, 7 Drawing Sheets

*FIG. 4*

400

INK LIMIT 125%

| | 1 | 2 | 3 | 4 |
|---|---|---|---|---|
| 1 | K, C | K | K | K |
| 2 | C | C, M | C | C |
| 3 | M | M | M, Y | M |
| 4 | Y | Y | Y | K, Y |
| 5 | K | K, C | K | K |
| 6 | C | C | C, M | C |
| 7 | M | M | M | M, Y |
| 8 | K, Y | Y | Y | Y |
| 9 | K | K | K, C | K |
| 10 | C | C | C | C, M |
| 11 | M, Y | M | M | M |
| 12 | Y | K, Y | Y | Y |
| 13 | K | K | K | K, C |
| 14 | C, M | C | C | C |
| 15 | M | M, Y | M | M |
| 16 | Y | Y | Y, K | Y |

125% AVG / ROW

PROCESS DIRECTION

125% AVG / COL

CUSTOM FLUSH LINE GENERATION IN PRINTING SYSTEMS THAT UTILIZE INK DRYING LIMITS

FIELD OF THE INVENTION

The invention relates to the field of printing systems, and in particular, to generating flush lines for printing systems.

BACKGROUND

Businesses or other entities having a need for volume printing typically purchase a production printer. A production printer is a high-speed printer used for volume printing (e.g., one hundred pages per minute or more). Production printers are typically continuous-forms printers that print on webs of print media that are stored on large rolls.

A production printer typically includes a localized print controller that controls the overall operation of the printing system, and a marking engine (sometimes referred to as an "imaging engine" or as a "print engine"). The marking engine includes one or more printhead assemblies, with each assembly including a printhead controller and a printhead (or array of printheads). An individual printhead includes multiple tiny nozzles (e.g., 360 nozzles per printhead depending on resolution) that are operable to discharge ink as controlled by the printhead controller. A printhead array is formed from multiple printheads that are spaced in series across the width of the print media.

When in operation, the web of print media is quickly passed underneath the printhead arrays while the nozzles of the printheads discharge ink at intervals to form pixels on the web. In order to ensure that ink does not partially dry within the printheads during printing (which would adversely affect print quality), flush lines are printed at page boundaries on the web. These flush lines are used to flush ink from the nozzles on a regular basis to ensure that the ink does not become overly viscous.

To reduce the visual footprint of individual flush lines, all of the nozzles located at a single horizontal position along a width of the web may be discharged at the same vertical location along the height of the web. This means that, at a single physical location, the web is saturated with a great deal of ink. For example, in cyan, magenta, yellow, and black (CMYK) printing systems, a C, M, Y, and K nozzle may each discharge a droplet at the same physical pel location on the page. This is repeated across the entire width of the page. These flush lines have a small overall size, but may oversaturate the web with ink, which can cause warping or distortion of the web, or even can smear or offset the ink to different portions of the printed page.

SUMMARY

Embodiments described herein identify ink drying limits for printing systems that use dryers. The ink drying limits indicate the amount of ink density that the printing system can properly dry. Based on the ink drying limit for the system, embodiments herein can generate customized flush lines that do not exceed the ink drying limit, take up a small amount of visual space on the printed page, and also ensure that the nozzles for the printing system are flushed at the desired frequency.

One embodiment is a system that includes a flush line generator able to receive a print job, to determine a drying limit that defines a maximum areal density of ink for the print job that may be dried by a dryer, and to generate a flush line based on the drying limit that does not exceed the drying limit. The system further includes a marking engine able to mark the print job and the flush line onto a web of printable media upstream from the dryer.

Another embodiment is a method for generating flush lines. The method includes receiving a print job, and determining a drying limit that defines a maximum areal density of ink that may be dried by a dryer. The method also includes generating a flush line based on the drying limit that does not exceed the drying limit, and marking the print job and the flush line onto a web of printable media upstream from the dryer.

Another embodiment is a non-transitory computer readable medium embodying programmed instructions which, when executed by a processor, are able to perform a method. The method includes receiving a print job, and determining a drying limit that defines a maximum areal density of ink that may be dried by a dryer. The method also includes generating a flush line based on the drying limit that does not exceed the drying limit, and marking the print job and the flush line onto a web of printable media upstream from the dryer.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

FIG. 4 is a block diagram illustrating a further flush pattern for a flush line in an exemplary embodiment.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
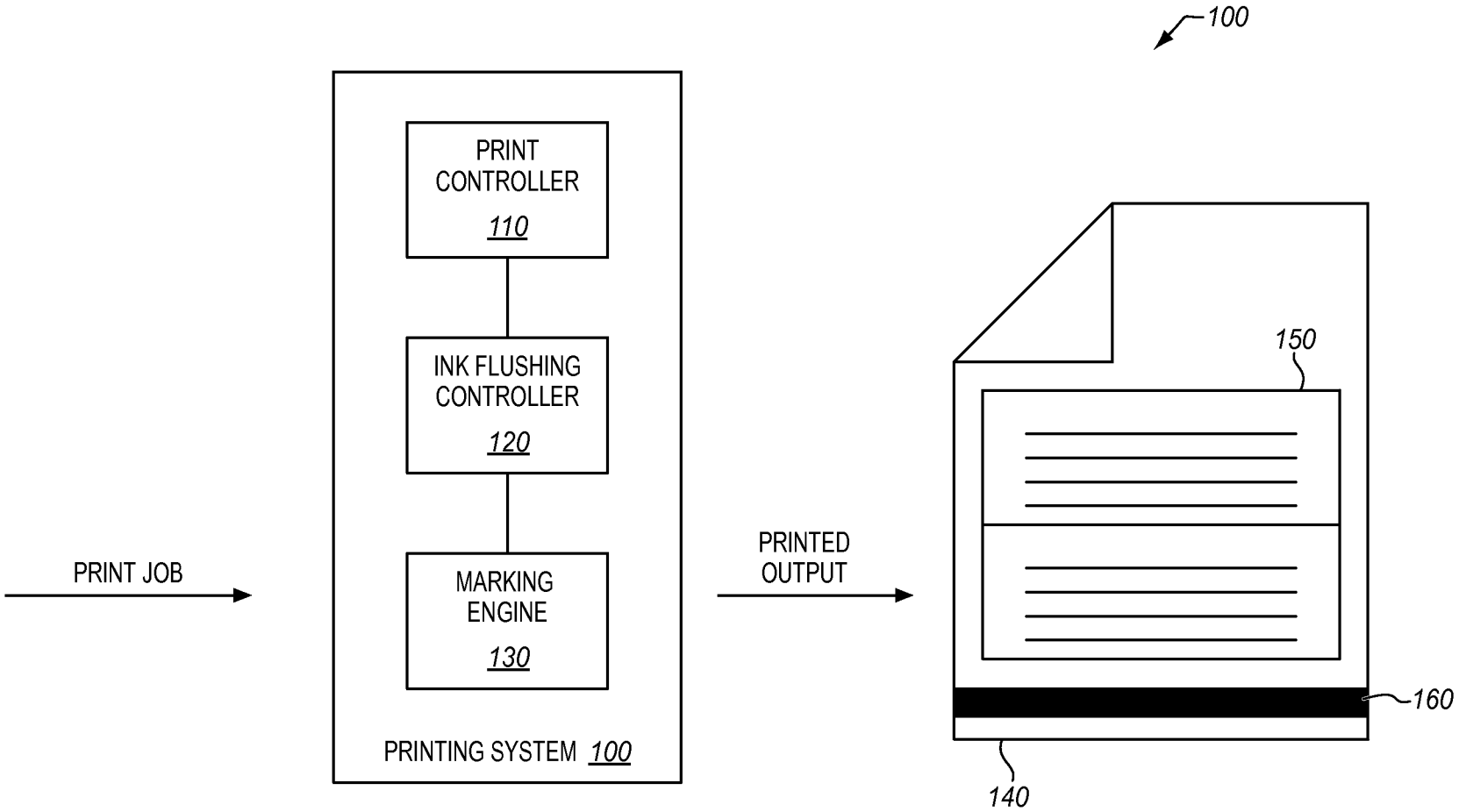
FIG. 1 is a block diagram of a printing system in an exemplary embodiment.

FIG. 1 is a block diagram of a printing system 100 in an exemplary embodiment. Printing system 100 comprises any system, device, or component operable to receive a print job and generate a marked physical output for the print job. In this embodiment, printing system 100 comprises a continuous-forms inkjet printing system that includes print controller 110, ink flushing controller 120, and marking engine 130. Print controller 110 may utilize one or more Rasterization Image Processors (RIPs) to translate Page Description Language (PDL) print jobs into a rasterized format, may process job tickets for print jobs, etc. Marking engine 130 marks a web of print media with ink to generate physical output for received print jobs, and ink flushing controller 120 generates flush lines for print jobs in order to ensure that ink does not dry (or otherwise change in viscosity) while it resides on printhead nozzles of marking engine 130, as this would adversely affect print quality.

In some existing printing systems, flush lines are generated without regard for the drying capabilities of the dryer that is being used. This means that the flush lines may be subject to smearing if the dryer is not sufficiently powerful. In other printing systems, each color is printed and dried separately, which requires a great deal more space at the print shop. In either case, the end result is undesirable.

Ink flushing controller 120 has been enhanced to address this problem by designing flush lines that do not exceed an ink drying limit defined for printing system 100. The ink drying limit indicates the maximum areal density of ink that may be dried by a dryer of printing system 100. Flushing controller 120 generates flush lines that will meet (but not exceed) this ink drying limit. Thus, the flush lines can be designed to ensure adequate drying at a downstream dryer, while still taking up a small amount of space on the printed page.

Ink flushing controller 120 may be implemented, for example, as custom circuitry, as a special or general purpose processor executing programmed instructions stored in an associated program memory, or some combination thereof. While ink flushing controller 120 is illustrated as an independent element in FIG. 1, in some embodiments ink flushing controller 120 may be integrated into print controller 110, or marking engine 130.

Illustrative details of the operation of printing system 100 will be discussed with regard to FIG. 2. Assume, for this embodiment, that printing system 100 has initialized and is awaiting receipt of a print job for processing.

Figure 2:
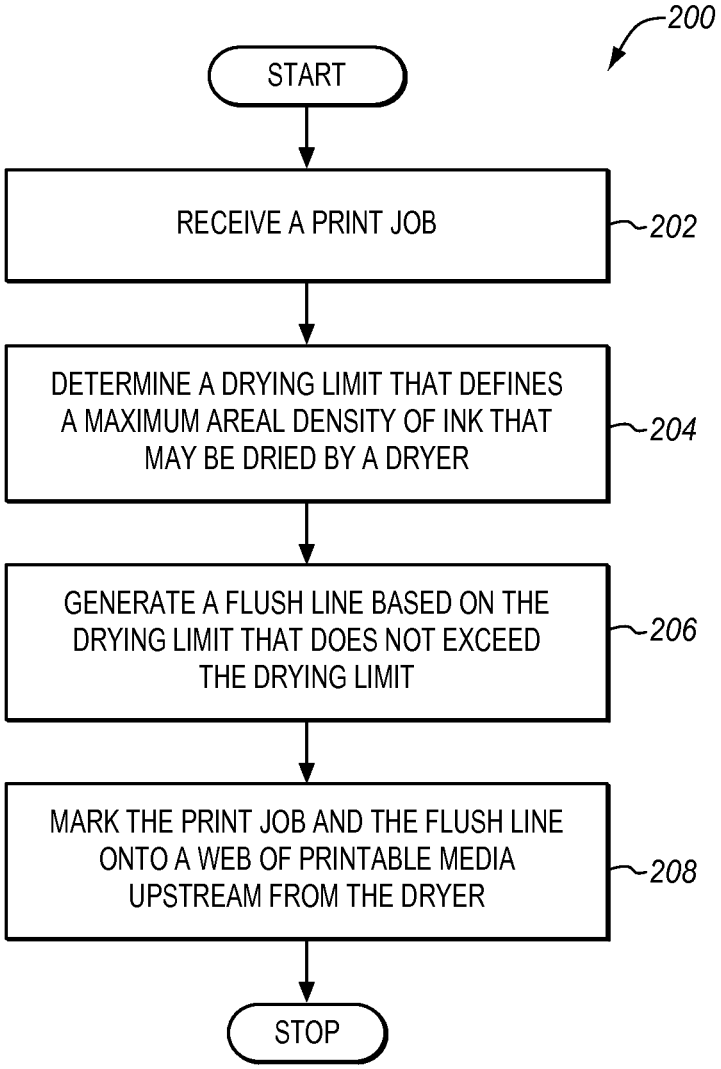
FIG. 2 is a flowchart illustrating a method for generating flush lines based on a drying limit in an exemplary embodiment.

FIG. 2 is a flowchart illustrating a method 200 for generating flush lines based on an ink drying limit in an exemplary embodiment. The steps of method 200 are described with reference to printing system 100 of FIG. 1, but those skilled in the art will appreciate that method 200 may be performed in other systems. The steps of the flowcharts described herein are not all inclusive and may include other steps not shown. The steps described herein may also be performed in an alternative order.

In step 202, printing system 100 receives a print job. The print job may comprise, for example, rasterized print data or a PDL version of the print data. If the print job includes PDL data, print controller 110 may rasterize the PDL print data to transform it into an appropriate format for marking engine 130.

In step 204, ink flushing controller 120 determines an ink drying limit for the print job. The ink drying limit defines a maximum areal density of ink that may be dried by a dryer of the printing system. This ink drying limit may be a function of ink used, web material used, temperature of the dryer, size of the dryer, speed of the web, power applied to the web, ambient humidity in the printing system, and many other factors. Thus, the ink drying limit may be constant for the printing system, or may vary depending on the settings for the print job. In one embodiment, ink flushing controller 120 is capable of determining the ink drying limit dynamically as a function of one or more of the above-listed variables.

Ink drying limits, which may also be known as "ink limits," are often defined as a percentage that indicates the number of ink droplets that may be placed, on average, per physical pel location on the page. For example, an ink limit that allows a maximum of one drop of ink (of any color) per pel position on average may be described as a 100% ink limit, while an ink limit that allows up to three drops of ink per pel position on average may be described as a 300% ink limit. While the ink limit may be exceeded for individual pels, on an areal basis (e.g., across small areas even less than ten pels in size) the ink limit is not exceeded.

Defining an ink limit on an areal basis still allows for adequate drying within the printing system, because surrounding pel locations (below the ink limit) may absorb some of the ink placed onto neighbor pel locations (which may be above the limit). The web will therefore still adequately dry even when individual pels are above the limit, so long as, on very small scales, the ink density does not exceed the limit.

In step 206, ink flushing controller 120 generates a flush line based on the drying limit that does not exceed the drying limit. For example, the flush line may include staggered patterns of ink droplets. In these patterns, not every ink of the printing system has to be flushed onto the same pel position on the page. For example, a flush pattern may be generated based on the following rules: each nozzle (for each color) flushes the same number of drops for the total pattern, the ink drying limit may only be exceeded by up to one droplet (and in regions no larger than one single pel), colors are evenly distributed throughout the pattern to allow for a more uniform visual appearance, and the single pel locations that exceed the drying limit are evenly spaced through the pattern to allow for a more uniform visual appearance and to ensure that on an areal basis, the ink drying limit is not exceeded.

The flush line therefore may not be uniform in its coloration, but will be substantially uniform in the areal density of ink applied to the page. Furthermore, because the average ink density of the flush line is below the ink limit, the flush line will adequately dry when it passes through a dryer of the printing system. Typically, flush lines will be repeated regularly throughout the print job (e.g., once per page, once every set distance of linear feet of a web of print media, etc.).

The exact height of the flush line on the page (i.e., the thickness of the flush line) may vary depending on the amount of ink that should be flushed per page to keep ink from partially drying onto the nozzles of marking engine 130. Ink flushing controller 120 may determine the amount of ink to flush as a hard-coded value, or may determine the amount based on the ink type used for the print job.

In step 208, marking engine 130 marks the print job and the flush line onto a web of printable media. This creates a physical output for the print job, which may then be dried by a downstream dryer, cut, and stacked for final delivery to a customer.

Using method 200 described above, a print shop may flush ink in a printing system to ensure that print quality meets the desired standards of a customer. At the same time, method 200 can ensure that flush lines used for the print job are not so oversaturated with ink that they will fail to dry when passed through a dryer of the printing system.

Figure 3:
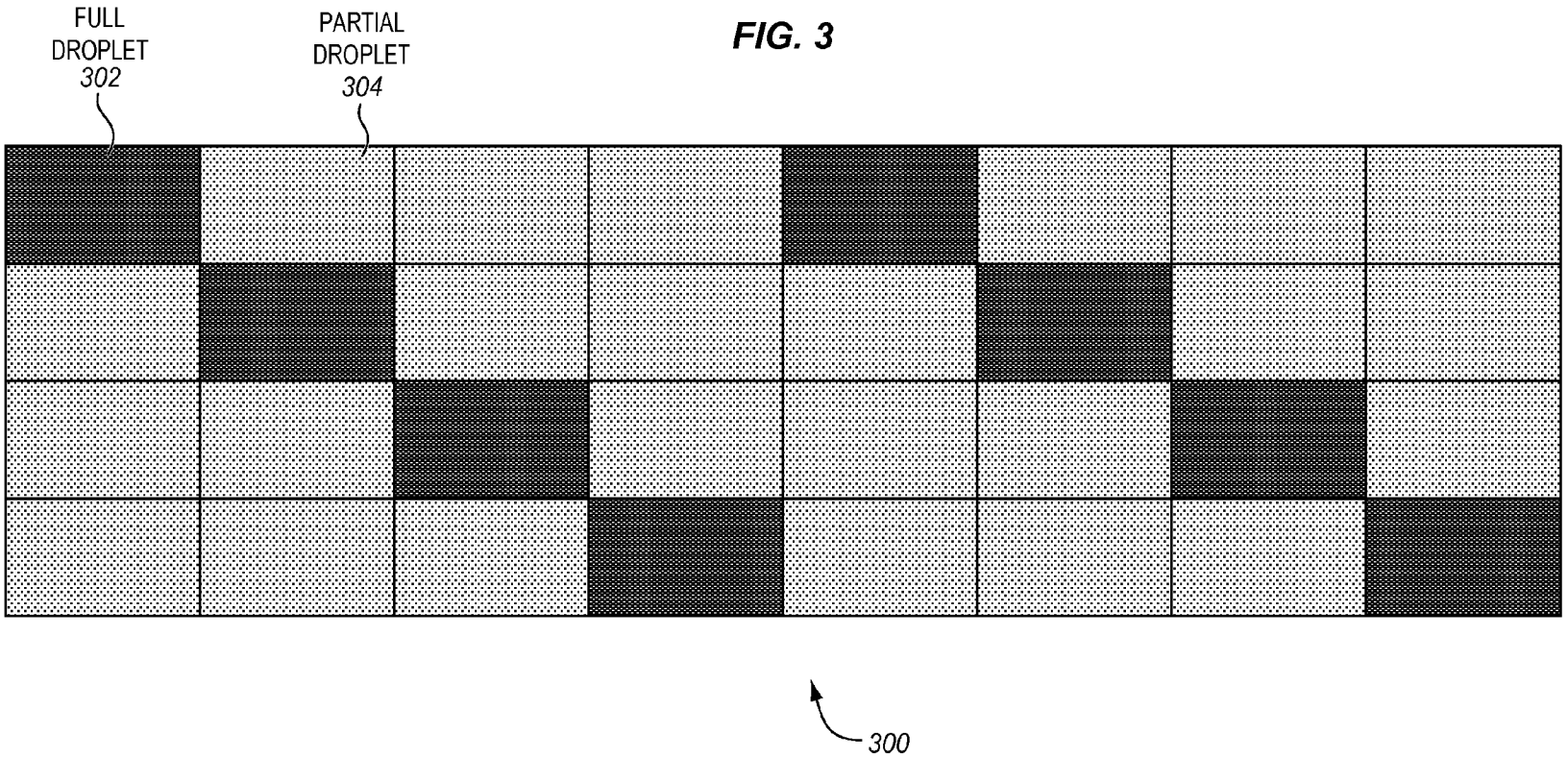
FIG. 3 is a block diagram illustrating a flush pattern for a flush line in an exemplary embodiment.

FIG. 3 is a block diagram illustrating a flush pattern 300 for a flush line in an exemplary embodiment. In FIG. 3, flush pattern 300 is generated in order to meet an ink drying limit for a monochrome printing system. The monochrome flush pattern is designed to meet the drying limit without exceeding the drying limit in the printing system, to ensure that the flush line takes up a small amount of space but still adequately dries. In FIG. 3, certain pel positions 302 include the largest possible droplets of black ink, while other pel positions 304 include smaller-volume droplets of black ink. The flush pattern is repeated across the width of the page. In FIG. 3, pel positions 302 are surrounded primarily by pel positions 304 that have less ink. Thus, the overall ink content for the flush line does not exceed the drying limit when measured on an areal basis.

FIG. 4 is a block diagram illustrating a further flush pattern 400 for a flush line in an exemplary embodiment. According to FIG. 4, flush pattern 400 flushes four different ink colors (cyan, magenta, yellow, black) at the same time. The specific colors of the droplets applied at each physical pel location on the page are indicated with the letters C, M, Y, and K, respectively. Flush pattern 400 is designed for a 125% ink limit, and meets the ink limit when measured by row or when measured by column. While flush pattern 400 is shown as only four pels wide, flush pattern 400 may be repeated across the width of the page so that each nozzle of marking engine 130 is properly flushed. Specifically, in each repetition of the flushing pattern, each nozzle of each color is flushed an equal amount. Depending on the overall amount of ink that should be flushed over time, the speed of the web, and the page size, ink flushing controller 120 may apply flush pattern 400 multiple times per page, or may split flush pattern 400 across multiple pages.

Figure 5:
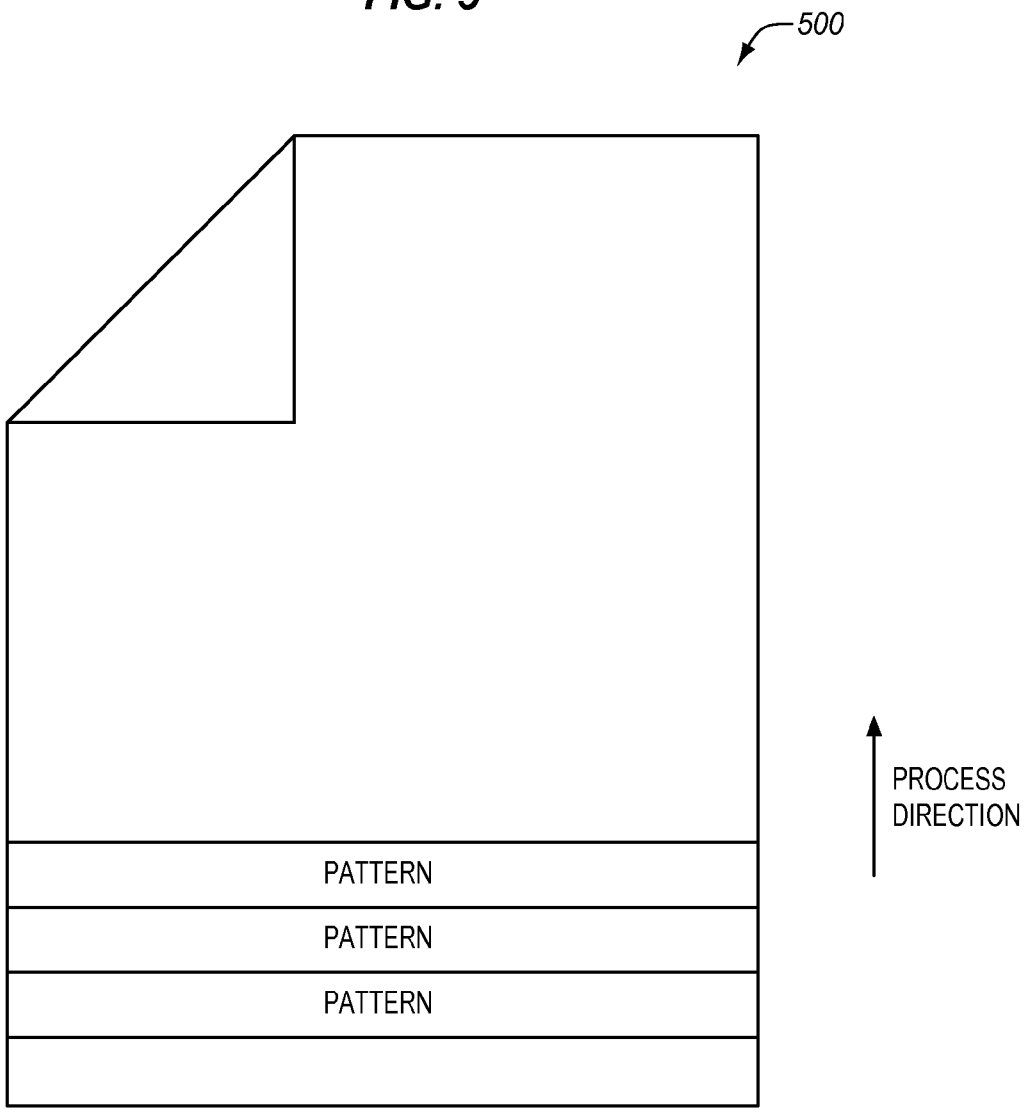
FIG. 5 is a block diagram illustrating multiple iterations of a single flush pattern in a flush line for a page in an exemplary embodiment.

FIG. 5 is a block diagram 500 illustrating multiple iterations of a single flush pattern on a flush line for a page in an exemplary embodiment. In FIG. 5, the flush pattern is repeated multiple times. If a flush pattern is particularly short, if page size is large, if the ink drying limit is particularly low, or if the linear speed of the web is slow, it may be desirable to repeat a flush pattern multiple times per page.

Figure 6:
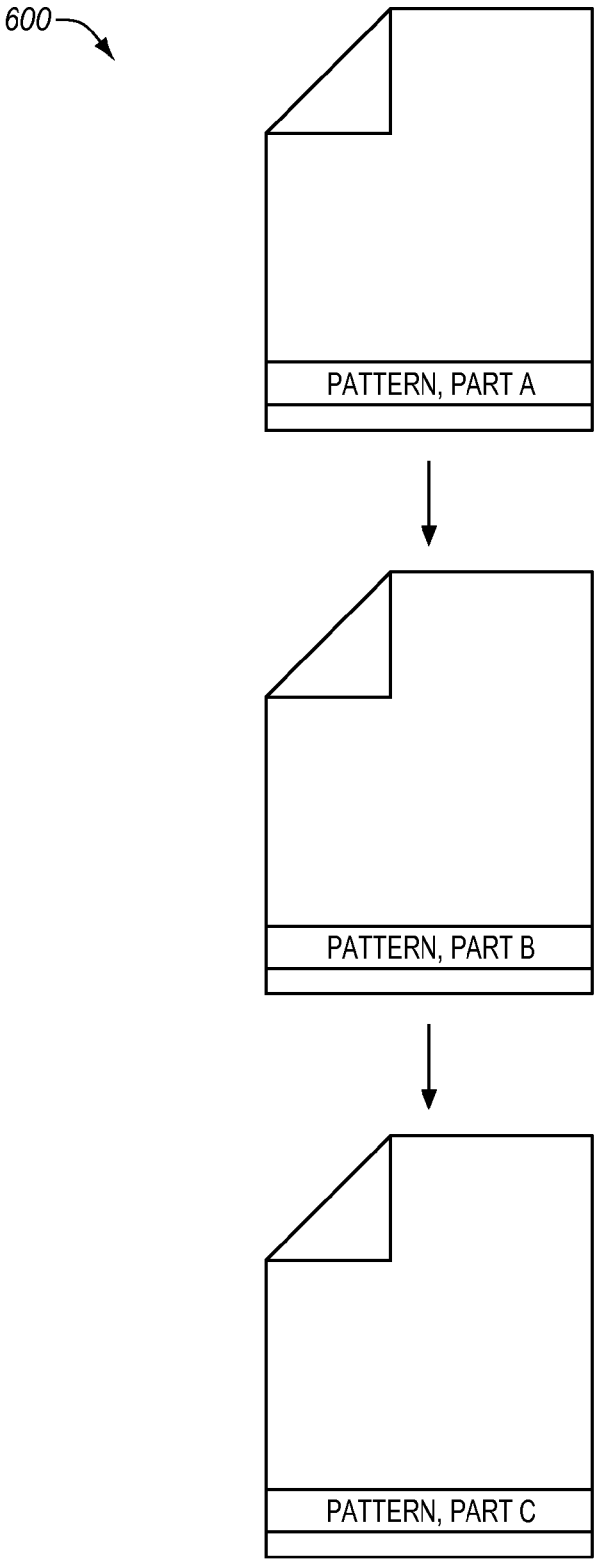
FIG. 6 is a block diagram illustrating a single flush pattern distributed across multiple flush lines for multiple pages in an exemplary embodiment.

FIG. 6 is a block diagram 600 illustrating a single flush pattern distributed across multiple flush lines for multiple pages in an exemplary embodiment. In FIG. 6, an entire iteration of the flush pattern does not have to be fully printing on each page, as the printhead nozzles do not need to flush an entire pattern's worth of ink per page in order to maintain print quality. Therefore, the pattern is split/distributed/spread across multiple pages to minimize the size of the flush lines appearing on each page. If a flush pattern is particularly long, if page size is small, if the ink drying limit is very high, or if the linear speed of the web is fast, it may be desirable to spread the flushing pattern across multiple pages.

In further embodiments, ink flushing controller 120 may dynamically generate flush patterns on the fly based on the ink drying limit. In still further embodiments, ink flushing controller 120 may include multiple pre-defined flush patterns, and may select a flush pattern based upon the determined ink limit for the print job.

In another further embodiment, ink flushing controller 120 flushes the largest available drop size of ink onto the page at a maximum flow rate. Flushing the largest available droplet of ink onto a physical pel location at once (instead of many smaller droplets of ink) increases the efficacy of the flushing process, because the higher energy imparted into the nozzle chambers by the droplets can surpass the surface tension requirements to eject partially dried ink out of the nozzles.

In a further embodiment, ink flushing controller 120 may be operated in a printing system that utilizes a radiant dryer. If the dryer uses radiant energy, then highly absorptive inks (e.g., black) will dry faster than less absorptive inks. Thus, ink flushing controller 120 may intentionally flush more black ink onto the flush line than is normally used to keep the black nozzles clean, because this will enhance the absorptive properties of the flush line, causing it to dry more quickly. This may be particularly desirable for portions of the flush line that would normally include light (and therefore less absorptive) inks

EXAMPLES

In the following examples, additional processes, systems, and methods are described in the context of a printing system that manages flush lines for a print job based upon an ink drying limit.

In this example, a continuous-forms inkjet printing system includes a radiant dryer. The radiant dryer operates at a fixed power level, generating a fixed amount of radiant heat. The inkjet printing system utilizes one type of ink, but in four colors: cyan, magenta, yellow, and black. The inkjet printing system also has a pre-defined ink drying limit of 125%, which means that, over an area of 16 pels (e.g., 4×4 pels) 20 pels may be flushed. A print controller of the printing system receives a print job, and determines that the print job utilizes all four colors of the printing system. Therefore, the printing system generates a flush pattern that flushes all four colors of ink from the printing system. The flush pattern is designed so that, when measured by column or by row, or when measured in 4×4 sections of pels, the flush pattern meets the ink limit but does not exceed it. The flush pattern further ensures that each nozzle of each color flushes equal amounts of droplets. Here, the flush pattern used is flush pattern 400 of FIG. 4. Flush pattern 400 is repeated horizontally across the width of the page, is repeated once per page, and occupies a full sixteen pels of vertical space per page (i.e., the flush pattern is 16 pels tall). The flush line is added to the print data for the print job, and then the print job is printed by an inkjet marking engine onto a continuous web of print media. The web passes underneath the radiant dryer as it travels at a linear rate of five feet per minute, and then is cut into sheets for stacking and delivery to a customer.

Figure 7:
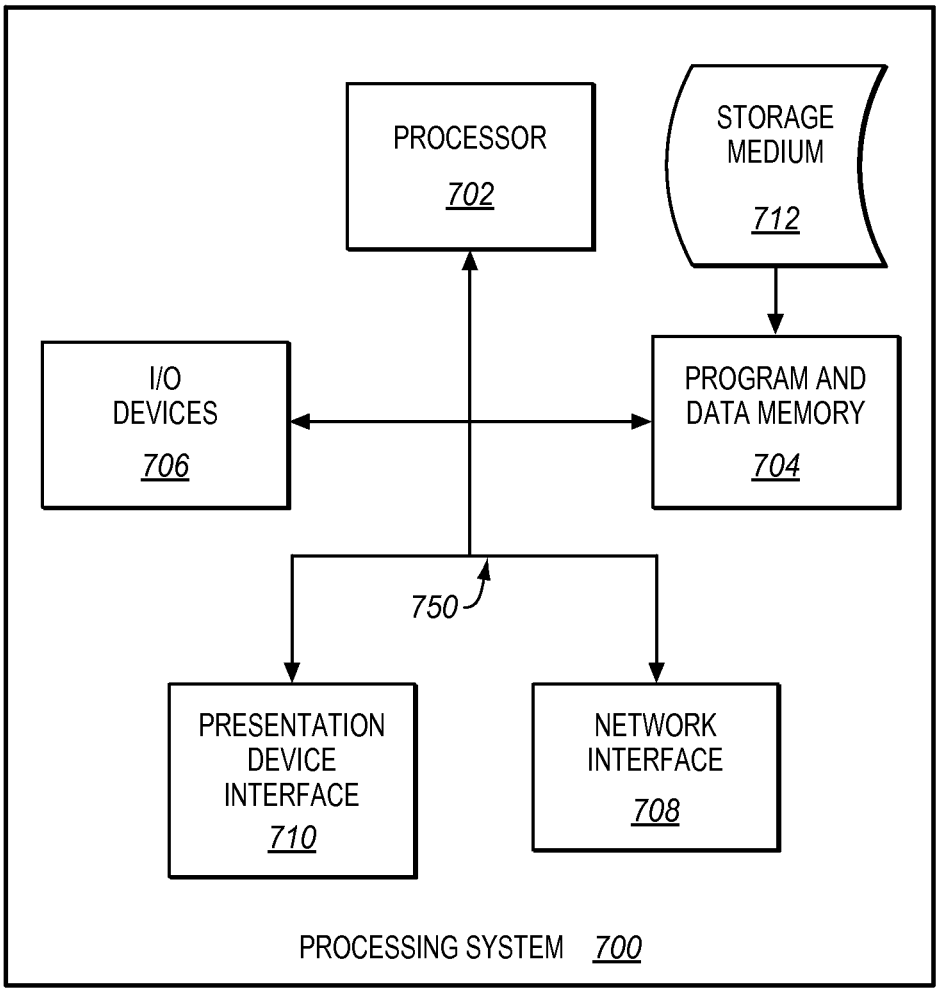
FIG. 7 illustrates a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of printing system 100 to perform the various operations disclosed herein. FIG. 7 illustrates a processing system 700 operable to execute a computer readable medium embodying programmed instructions to perform desired functions in an exemplary embodiment. Processing system 700 is operable to perform the above operations by executing programmed instructions tangibly embodied on computer readable storage medium 712. In this regard, embodiments of the invention can take the form of a computer program accessible via computer-readable medium 712 providing program code for use by a computer or any other instruction execution system. For the purposes of this description, computer readable storage medium 712 can be anything that can contain or store the program for use by the computer.

Computer readable storage medium 712 can be an electronic, magnetic, optical, electromagnetic, infrared, or semiconductor device. Examples of computer readable storage medium 712 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 700, being suitable for storing and/or executing the program code, includes at least one processor 702 coupled to program and data memory 704 through a system bus 750. Program and data memory 704 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 706 (including but not limited to keyboards, displays, pointing devices, etc.) can be coupled either directly or through intervening I/O controllers. Network adapter interfaces 708 may also be integrated with the system to enable processing system 700 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 710 may be integrated with the system to interface to one or more presentation devices, such as printing systems and displays for presentation of presentation data generated by processor 702.

Although specific embodiments were described herein, the scope of the invention is not limited to those specific embodiments. The scope of the invention is defined by the following claims and any equivalents thereof.

We claim:

1. A system comprising:

a flush line generator operable to receive a print job, to determine a drying limit that defines a maximum areal density of ink that may be dried by a dryer, and to generate a flush line based on the drying limit that does not exceed the drying limit; and a marking engine operable to mark the print job and the flush line onto a web of printable media upstream from the dryer.

2. The system of claim 1 wherein:

the flush line generator is further operable to generate the flush line as a pattern of droplets that are each the largest size that can be ejected from the nozzles.

3. The system of claim 1 wherein:

the flush line generator is further operable to generate a flush pattern for the flush line that matches the drying limit when measured by column of pels or by row of pels.

4. The system of claim 3 wherein:

the flush line generator is further operable to distribute the generated flush pattern across multiple flush lines that each occupy a different page of the print job.

5. The system of claim 3 wherein:

the flush line generator is further operable to repeat the generated flush pattern multiple times within a single flush line of a single page.

6. The system of claim 1 wherein:

the dryer comprises a radiant dryer; and the flush line generator is further operable to add black ink to light portions of the flush line to increase the amount of radiant energy absorbed by those portions and thereby improve the maximum areal ink density that can be dried in those portions.

7. The system of claim 1 wherein:

the drying limit defines the maximum areal density as a maximum average ratio of droplets discharged on the web to physical pixel locations available at the web, measured on a multi-pel basis.

8. The system of claim 1 further comprising:

a memory that stores multiple flush patterns, each flush pattern corresponding to a drying limit; wherein the flush line generator is further operable, responsive to determining the drying limit, to select a flush pattern that corresponds with the drying limit, and to generate the flush line based on the flush pattern.

9. A method comprising:

receiving a print job;

determining a drying limit that defines a maximum areal density of ink that may be dried by a dryer;

generating a flush line based on the drying limit that does not exceed the drying limit; and marking the print job and the flush line onto a web of printable media upstream from the dryer.

10. The method of claim 9 further comprising:

generating the flush line as a pattern of droplets that are each the largest size that can be ejected from the nozzles.

11. The method of claim 9 further comprising:

generating a flush pattern for the flush line that matches the drying limit when measured by column of pels or by row of pels.

12. The method of claim 11 further comprising:

distributing the generated flush pattern across multiple flush lines that each occupy a different page of the print job.

13. A non-transitory computer readable medium embodying programmed instructions which, when executed by a processor, are operable for performing a method comprising:

receiving a print job;

determining a drying limit that defines a maximum areal density of ink that may be dried by a dryer;

generating a flush line based on the drying limit that does not exceed the drying limit; and marking the print job and the flush line onto a web of printable media upstream from the dryer.

14. The medium of claim 13 wherein the method further comprises:

generating the flush line as a pattern of droplets that are each the largest size that can be ejected from the nozzles.

15. The medium of claim 13 wherein the method further comprises:

generating a flush pattern for the flush line that matches the drying limit when measured by column of pels or by row of pels.

16. The medium of claim 15 wherein the method further comprises:

distributing the generated flush pattern across multiple flush lines that each occupy a different page of the print job.

17. The medium of claim 15 wherein the method further comprises:

repeating the generated flush pattern multiple times within a single flush line of a single page.

18. The medium of claim 13 wherein:

the dryer comprises a radiant dryer; and the method further comprises adding black ink to light portions of the flush line to increase the amount of radiant energy absorbed by those portions and thereby improve the maximum areal ink density that can be dried in those portions.

19. The medium of claim 13 wherein:

the drying limit defines the maximum areal density as a maximum average ratio of droplets discharged on the web to physical pixel locations available at the web, measured on a multi-pel basis.

20. The medium of claim 13 wherein the method further comprises:

storing multiple flush patterns, each flush pattern corresponding to a drying limit;

selecting, responsive to determining the drying limit, a flush pattern that corresponds with the drying limit; and generating the flush line based on the flush pattern.

* * * * *